US005279520A

United States Patent [19]

Robinson, Jr.

[11] Patent Number: 5,279,520

[45] Date of Patent: Jan. 18, 1994

[54] CEILING MOUNTED FORCED AIR VENT HUMIDIFIER AND DRAFT CONTROL DEVICE

[76] Inventor: Carl R. Robinson, Jr., 16668 Mt. Hoffman Cir., Fountain Valley, Calif. 92708

[21] Appl. No.: 2,954

[22] Filed: Jan. 11, 1993

[51] Int. Cl.[5] ..... B01F 3/04

[52] U.S. Cl. ..... 454/328; 261/84; 261/119.1

[58] Field of Search ..... 454/328, 291; 261/119.1, 83, 84

[56] References Cited

U.S. PATENT DOCUMENTS

| | | | |
|---|---|---|---|
| 544,175 | 8/1895 | Iliowizi | 454/328 |
| 1,293,582 | 2/1919 | Van Evera | 454/291 |
| 1,581,243 | 4/1926 | Stueber | 454/328 |
| 1,786,331 | 12/1930 | Besch | 454/328 |
| 2,161,001 | 6/1939 | Bedol | 454/328 |
| 2,203,552 | 6/1940 | Teevin | 454/328 |
| 2,570,033 | 10/1951 | Kuss | 454/328 |
| 2,960,022 | 11/1960 | Dorsey | 454/328 |
| 2,997,938 | 8/1961 | Sievert et al. | 454/328 |
| 3,227,064 | 1/1966 | Spangle | 454/328 |
| 3,350,322 | 10/1967 | Waterhouse | 261/119.1 |
| 3,687,424 | 8/1972 | Katzman et al. | 261/119.1 |
| 4,031,180 | 6/1977 | Bohanon | 55/233 |
| 4,226,174 | 10/1980 | Vesper | 454/328 |
| 4,307,656 | 12/1981 | Vesper | 454/328 |
| 4,654,198 | 3/1987 | Berardini | 454/328 |
| 4,833,895 | 5/1989 | Johnson | 261/84 |
| 5,058,227 | 10/1991 | Schoenfelder | 261/119.1 |

*Primary Examiner*—Tim Miles
*Attorney, Agent, or Firm*—Dennis W. Beech

[57] ABSTRACT

An improved reliable easily installed and maintained humidifier and draft control that is installed on a common ceiling mounted forced air duct output register and has an easily replaced and maintained water bowl and fan mounted above the water bowl that has radially extending fan blades about an axle in the center of the fan that rotates when air is discharged from the register and the air is directed to facilitate air movement that assures evaporation of the liquid placed in the bowl and the fan blades may be shaped to direct the flow in a predetermined manner.

5 Claims, 4 Drawing Sheets

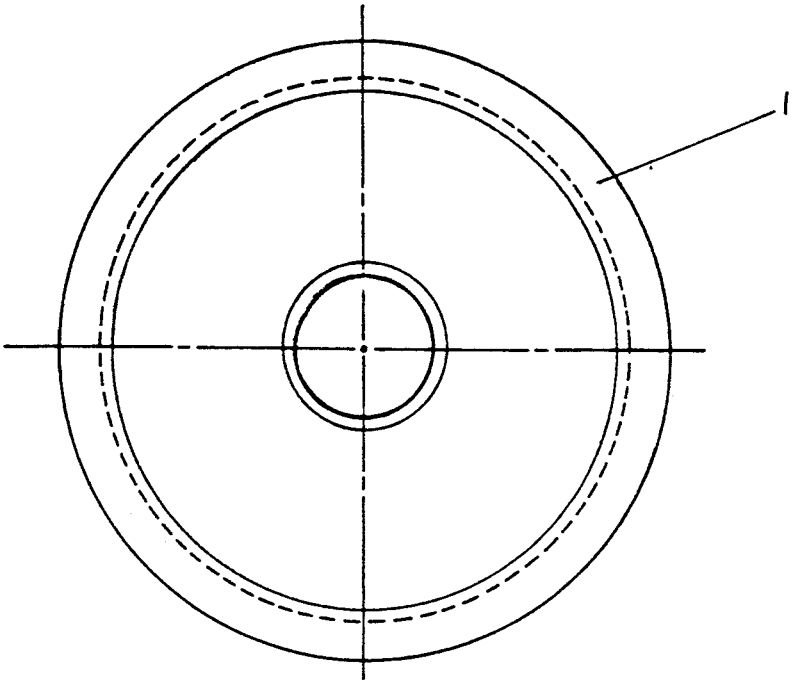
FIG. 6
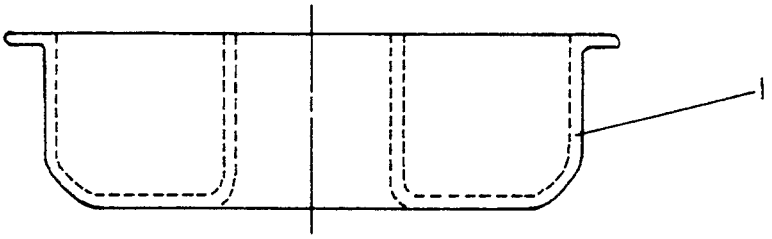
FIG. 7
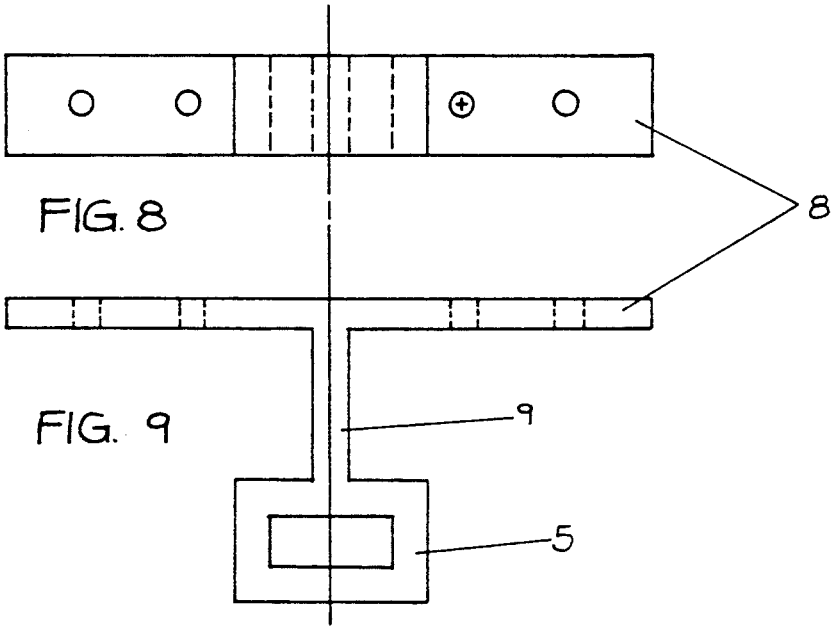
FIG. 8
FIG. 9

CEILING MOUNTED FORCED AIR VENT HUMIDIFIER AND DRAFT CONTROL DEVICE

FIELD OF THE INVENTION

The instant invention relates to an improved ceiling mounted humidifier attached to a ceiling forced air vent.

DESCRIPTION OF RELATED ART

Other devices similar to the ceiling mounted forced air vent humidifier and draft control device are difficult or impractical to use. The prior arts cited in U.S. patents include Berardini (U.S. Pat. No. 4,654,198), Vesper (U.S. Pat. No. 4,226,174), Bohanon (U.S. Pat. No. 4,031,180), A. P. Sievert (U.S. Pat. No. 2,997,938), E. P. Dorsey (U.S. Pat. No. 2,960,022), C. A. Besch (U.S. Pat. No. 1,786,331), W. S. Spangle (U.S. Pat. No. 3,227,064), M. J. Kuss (U.S. Pat. No. 2,570,033) and Vesper (U.S. Pat. No. 4,307,656). The prior art does not specifically address the application of the general user, affordability, cost to manufacturer or maintenance. The prior inventions do not provide an easily mounted, adjustable and reliable ceiling mounted air vent humidifier and draft control device with a minimum of obstruction to the forced air movement utilizing a fan to assure increase evaporation.

SUMMARY OF THE INVENTION

The primary objective of this device is to increase the level of humidity within a room. The device is designed to work in cooperation with existing forced air heating and air conditioning units, specifically those systems using ceiling vents to distribute the air. The effect of the increase humidity in adding moisture to the air is to reduce the fuel needed to heat the room to a comfortable level. A lower temperature setting may be used and the energy inefficiencies associated with greater changes in the room temperature can be avoided. The increased moisture reduces the damage common to household furnishings as well as some building materials that suffer undue deterioration as a result of an artificially induced low humidity. An even more stable level of heat distribution is also a result. The increase in humidity helps prevent the harsh drying of skin common with heated air conditioners. Properly serviced the device assists in trapping and removing from the air some of the heavier air pollutants.

In accordance with the description presented herein, other objectives of this invention will become apparent when the description and drawings are reviewed.

BRIEF DESCRIPTION OF THE DRAWING

FIG. 6 illustrates the top view of the bowl separated from the assembly.

FIG. 7 illustrates the side view of the bowl separated from the assembly.

FIG. 8 illustrates the top view of the mounting bracket separated from the assembly.

FIG. 9 illustrates one of the side views of the mounting bracket separated from the assembly.

DESCRIPTION OF THE PREFERRED EMBODIMENT

Figure 1:
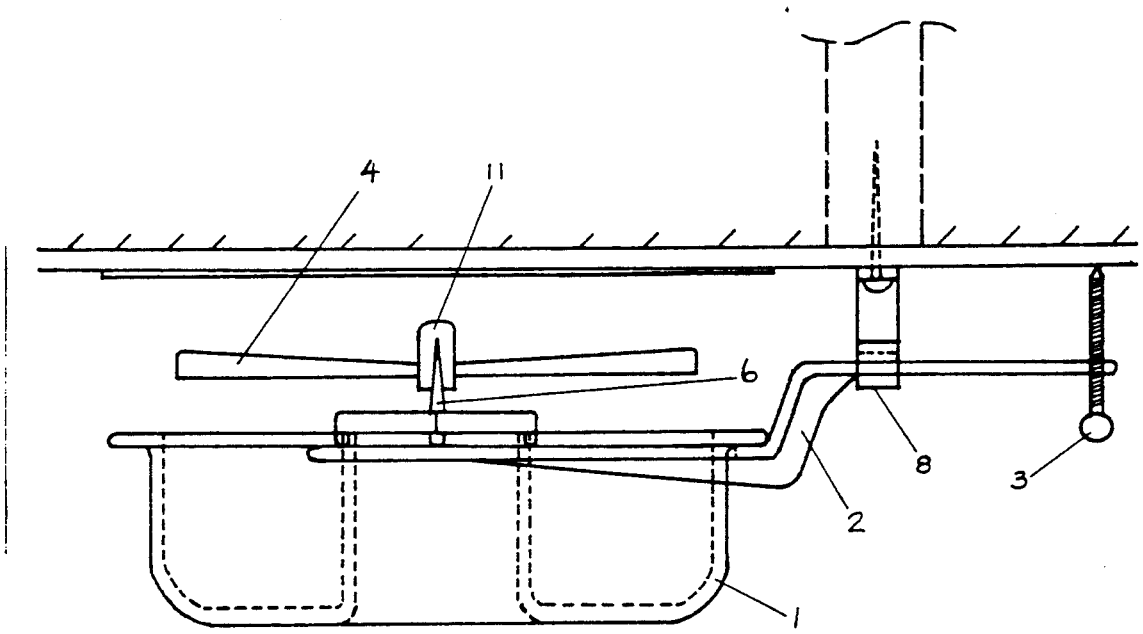
FIG. 1 illustrates the front view of the improved ceiling mounted forced air humidifier.
Figure 2:
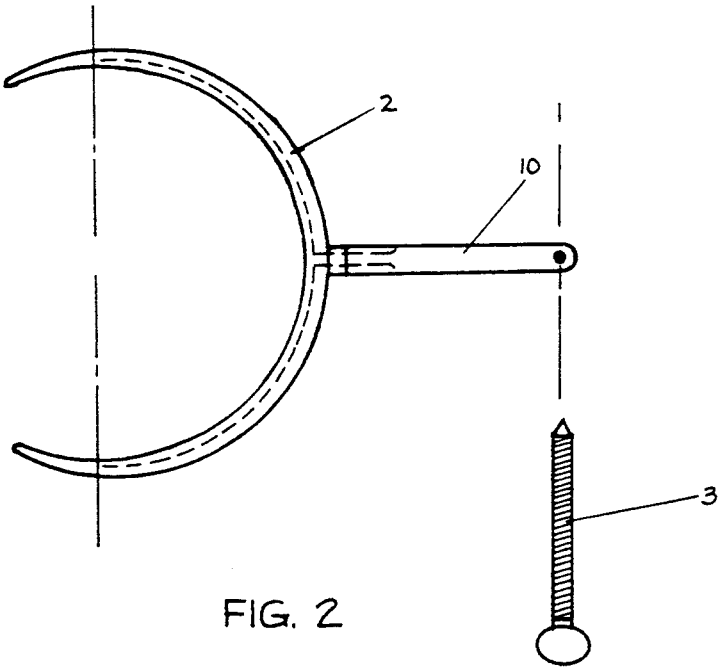
FIG. 2 illustrates the top view taken of the crescent shaped bowl cradle separated from the assembly.
Figure 3:
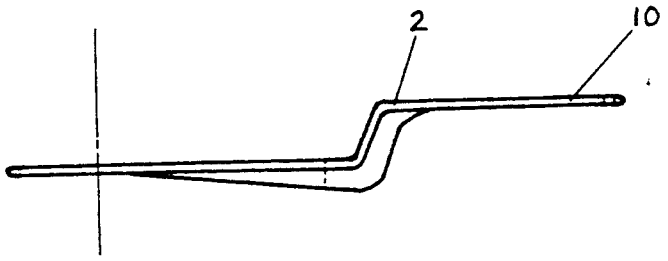
FIG. 3 illustrates the side view of the crescent shaped bowl cradled separated from the assembly.
Figure 4:
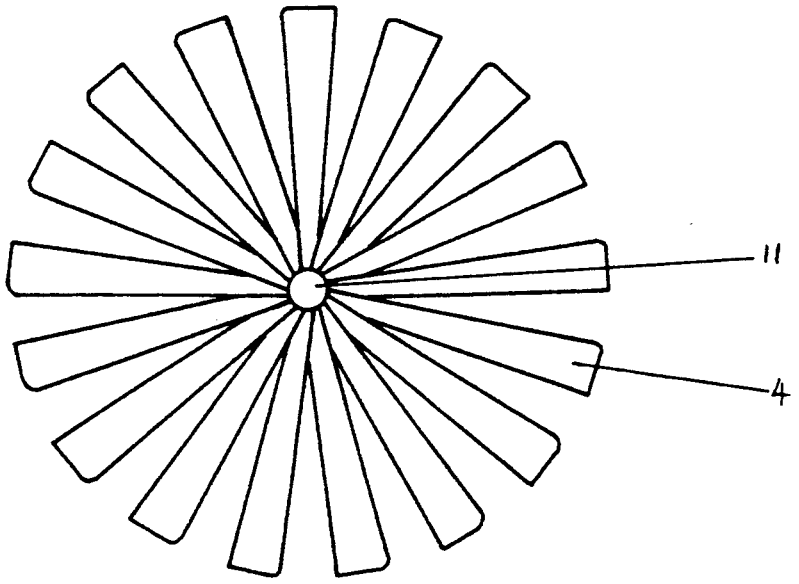
FIG. 4 illustrates the top view of the fan separated from the assembly.
Figure 5:
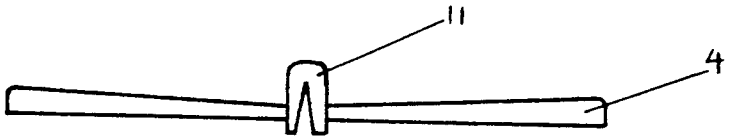
FIG. 5 illustrates the side vide of the fan separated from the assembly.
Figure 10:
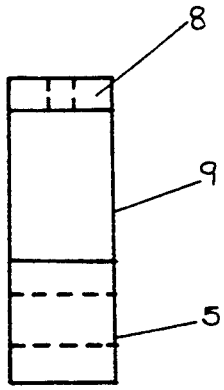
FIG. 10 illustrates one of the side views of the mounting bracket separated from the assembly.
Figure 11:
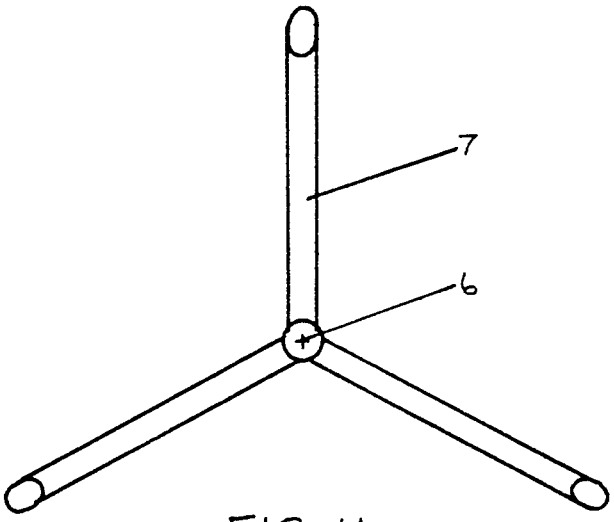
FIG. 11 illustrates the top view of the fan mount separated from the assembly.
Figure 12:
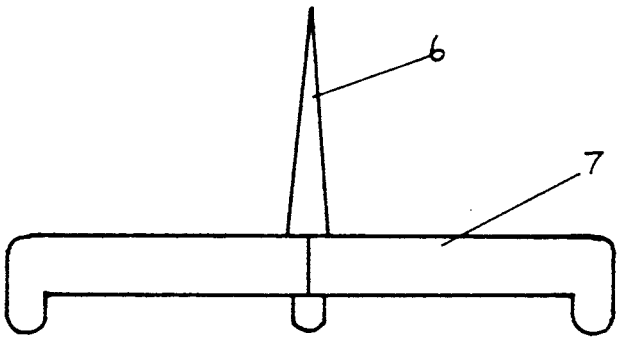
FIG. 12 illustrates the side vide of the fan mount separated from the assembly.

Referring to FIGS. 1 to 12, the improved ceiling mounted humidifier is shown. The drawing illustrates the complete assembly as well as the separated parts used to attach and suspend the unit to a ceiling vent register.

A mounting bracket strap (8) is made of a flat metal of a non-corrosive finish. Mounting bracket straps (8) that are approximately five (5) inches in length and ½ inches in width have proven satisfactory. The mounting bracket strap (8) has holes placed along the length. These holes are of sufficient diameter to allow wood screws to pass through and attach themselves to one of the ceiling joints used to anchor an air vent register. Two holes are approximately 1 inch from either end. The second two holes will be approximately 2 inches from either end of the mounting bracket strap (8). Near the center of the mounting bracket strap (5) is attached a slotted mounting bracket (8). In the preferred embodiment the attached extension (9) is attached and placed at a ninety degree angle and extends downward for approximately one inch. At the end of attachment means (9) is the slotted mounting bracket (5) having a rectangular opening. The slotted opening in the slotted mounting bracket (5) is sufficient to accept the crescent shaped bowl mounting arm (10). Openings of approximately one inch in width and one half inch in length have been shown to be sufficient. The mounting bracket strap (8) shall be centered and attached along the side of the outer frame of the forced air register.

The crescent shaped bowl mounting bracket (2) is made of sturdy, non-corrosive material. The crescent shaped bowl mounting bracket (2) has two parts. One part is shaped as a crescent. The diameter of the crescent is slightly larger than the bowl (1). Crescent diameter of twelve inches have been found satisfactory. Attached to the crescent shaped mounting bracket (2) is the crescent shaped bowl mounting arm (10) extending outward from the center of the outer section of the crescent shaped bowl mounting bracket (2). The crescent shaped bowl mounting arm (10) shall have an offset with the crescent shaped bowl mounting bracket (2). The crescent shaped bowl mounting arm (10) is bent upward at an approximate eighty-five degree angle for three inches. The crescent shaped bowl mounting arm (10) is parallel to the crescent shaped mounting bracket (2). A hole to receive the thumb adjustable bolt (3) is located away from the end of the crescent shaped bowl mounting arm (10) not attached to the crescent shaped mounting bracket (2). A distance of one half inch from the end of the crescent shaped bowl mounting arm (10) has been found sufficient. When in the mounted position the crescent shaped mounting arm (10) is placed through rectangular openings of the slotted metal strap.

The thumb adjustment bolt (3) is approximately two and one half inches in length. The threads are consistent to match the threaded hole on the crescent shaped mounting bracket (2). In the preferred embodiment, the head of the thumb adjustment bolt (3) is enlarged and shaped to allow the turning movement to be accomplished by a thumb and finger. The thumb adjustment bolt (3) is used to obtain a level horizontal position for the bowl.

A bowl (1) made of a transparent, non-porous material that contains liquid and shaped in the form of a ring is placed in the crescent shaped bowl mounting bracket (2). Approximately twelve inches has been found sufficient for the outer diameter of the bowl (1). In the preferred embodiment an upper one half inch portion of the bowl (1) is flared outward for approximately an additional ¾ inch. The flaring allows the bowl (1) to be placed inside the crescent shaped bowl mounting bracket (2) in a horizontal position. The bowl (1) is formed in a ring with the center open. The annular water retaining disk is sufficiently deep to contain enough water to assure evaporation for a period of time. Bowl (1) depths of approximately three and one half inches in depth have proven sufficient. The upper inside portion of the ring wall of the bowl (1) is approximately 3 inches in diameter. The bowl (1) when in the mounted position is as close to the center of the forced air vent register and directly below the register.

The fan mounting unit (7) is made of a sturdy, rigid and non-corrosive material. In the preferred embodiment, the fan mount unit (7) is comprised of three legs extending horizontally outward from a center axle (6). The legs are of sufficient length to extend slightly beyond the bowl (1) inner ring wall. The outer tips of the legs are bent downward to provide sufficient surface to the inner ring to assure stability with minimal shifting. The center axle (6) is a vertical shaft extending upward from the center of the fan mount unit (7) a sufficient distance to serve as a pivot approximately one and one half inches from the fan mount point. The pivot end of the center axle (6) is dome-shaped and smooth.

The fan (4) is made of a rigid lightweight, non-corrosive material. The fan (4) has fan blades extending outward from the center and at the center of the fan a hollow shaft (11) of approximately one inch in depth. The hollow shaft (6) in cooperation with the center axle (6) allows the fan (4) to be placed loosely over the pivot end of the center axle (6). Curved flare blades extending outward from the hollow shaft (6) for approximately ten inches have been found sufficient. The fan blades are curved and bent to maximize the rotation of the fan (4) when acted on by air being forced from the air duct. The redirected flow reduces the draft that is often associated with just the forced air pattern of a typical register opening.

I claim:

1. An improved ceiling mounted forced air humidifier and draft control;
   a. a bowl in the shape of an annular ring an open surface at the top and an attachment means to attach the bowl to a mounting bracket;
   b. a mounting strap that attaches to a ceiling;
   c. a mounting bracket that attaches to the mounting strap and the bowl and holds the bowl in a predetermined position;
   d. a radial fan with an axle protruding from the center of the radial fan;
   e. a radial fan mounting that accepts the axle protruding from the fan and suspends the fan over the bowl.

2. An improved ceiling mounted forced air humidifier and draft control as in claim 1 wherein the attachment means to attach the bowl to the mounting bracket utilizes a crescent shaped mounting bracket.

3. An improved ceiling mounted forced air humidifier and draft control as in claim 1 wherein the attachment means of the bowl to the mounting strap utilize a pivoting device that allows adjustable bowl positions.

4. An improved ceiling mounted forced air humidifier and draft control as in claim 1 wherein the bowl is transparent.

5. An improved ceiling mounted forced air humidifier and draft control as in claim 1 wherein the radial fan has blades that are curved to redirect air incident as the blades to alter the air flow in a predetermined pattern.

* * * * *